US009120234B2

(12) United States Patent
MacNair et al.

(10) Patent No.: US 9,120,234 B2
(45) Date of Patent: Sep. 1, 2015

(54) LOCKING FOLDING KNIFE

(75) Inventors: James MacNair, Newberg, OR (US); Timothy James Galyean, Newberg, OR (US); Craig Donald Kemp Green, Newberg, OR (US)

(73) Assignee: Kai U.S.A., Ltd., Tualatin, OR (US)

( * ) Notice: Subject to any disclaimer, the term of this patent is extended or adjusted under 35 U.S.C. 154(b) by 202 days.

(21) Appl. No.: 13/351,056

(22) Filed: Jan. 16, 2012

(65) Prior Publication Data

US 2012/0180321 A1 Jul. 19, 2012

Related U.S. Application Data

(60) Provisional application No. 61/433,917, filed on Jan. 18, 2011, provisional application No. 61/582,057, filed on Dec. 30, 2011.

(51) Int. Cl.
*B26B 1/02* (2006.01)
*B26B 1/04* (2006.01)

(52) U.S. Cl.
CPC ..... *B26B 1/044* (2013.01)

(58) Field of Classification Search
USPC ..... 30/167, 155–161, 153, 138; D8/95–100; 7/120, 165, 118, 119
See application file for complete search history.

(56) References Cited

U.S. PATENT DOCUMENTS

| | | | | |
|---|---|---|---|---|
| 1,478,260 | A * | 12/1923 | Sibley | 30/157 |
| 5,755,035 | A * | 5/1998 | Weatherly | 30/161 |
| 6,668,460 | B2 * | 12/2003 | Feng | 30/161 |
| 7,062,856 | B2 * | 6/2006 | Moser | 30/160 |
| 2009/0119926 | A1 * | 5/2009 | Nenadic | 30/161 |
| 2010/0313427 | A1 * | 12/2010 | Hsu | 30/161 |
| 2011/0119926 | A1 * | 5/2011 | Klecker | 30/161 |

OTHER PUBLICATIONS

"SiDiS . . . or there are things in the order of magnitude higher," Guns.ru, http://forum.guns.ru/forummessage/5/626540-5.html, May 2, 2010, 16 pages.

* cited by examiner

*Primary Examiner* — Ghassem Alie
(74) *Attorney, Agent, or Firm* — Alleman Hall McCoy Russell & Tuttle LLP

(57) ABSTRACT

A folding knife includes a handle, a blade pivotably connected to the handle, and a lockbar for locking the blade in an open position relative to the handle. The lockbar and the handle are separate pieces. The handle includes a pocket into which at least a portion of the lockbar is fit.

20 Claims, 7 Drawing Sheets

LOCKING FOLDING KNIFE

CROSS REFERENCE TO RELATED APPLICATIONS

This application claims priority to U.S. Provisional Application No. 61/433,917, filed Jan. 18, 2011, and U.S. Provisional Application No. 61/582,057, filed Dec. 30, 2011. These applications are incorporated by reference in their entirety for all purposes.

SUMMARY

A folding knife includes a lockbar for automatically locking a knife blade in an opened position. The lockbar and the back handle are separate pieces and optionally can be made from different materials.

DETAILED DESCRIPTION

Figure 1:
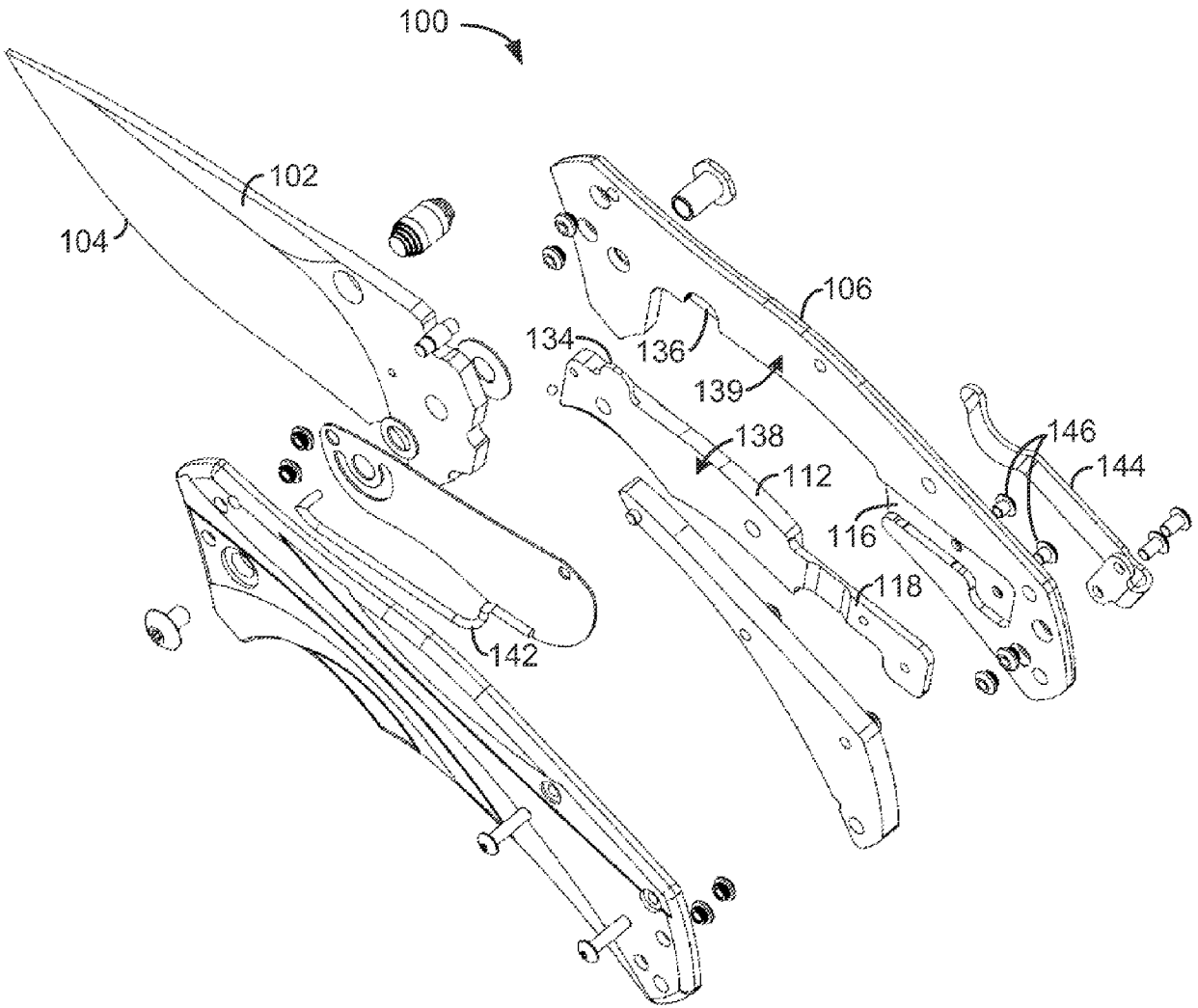
FIG. 1 is an exploded view of an example folding knife in accordance with an embodiment of the present disclosure.

FIG. 1 shows an exploded view of a folding knife 100 in accordance with an example embodiment of the present disclosure. Knife 100 includes a blade 102 with a cutting edge 104. Blade 102 is pivotally connected to a back handle 106 in a manner that allows the blade to pivot between opened and closed positions. When pivoting, blade 102 remains in a folding plane that is orthogonal to a pivot axis.

Figure 2A:
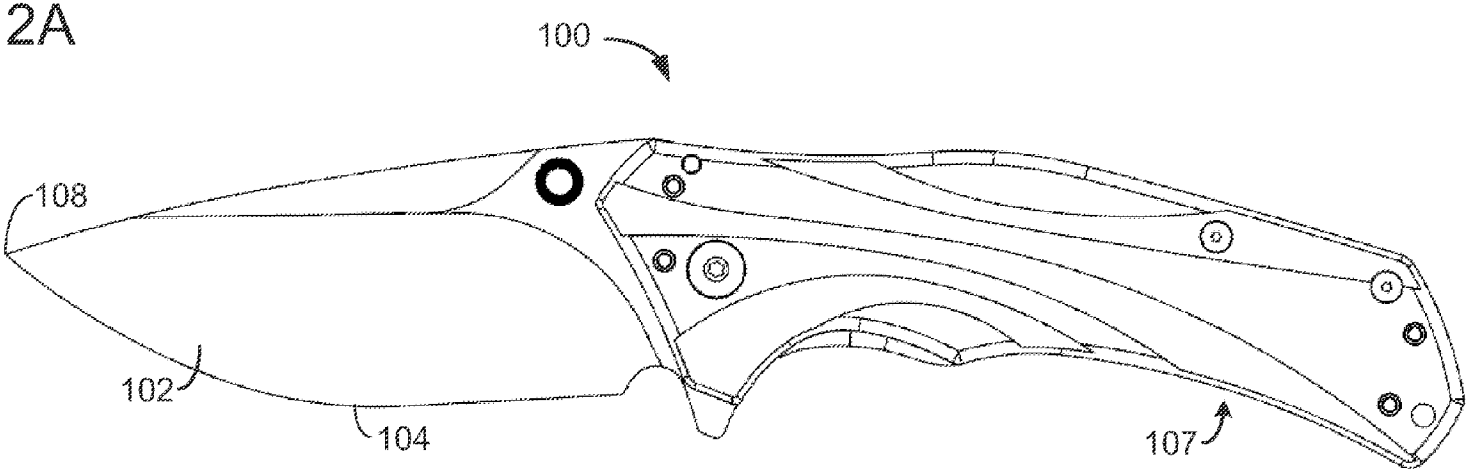
FIGS. 2A and 2B are plan views showing the knife of FIG. 1 in an opened position.
Figure 2B:
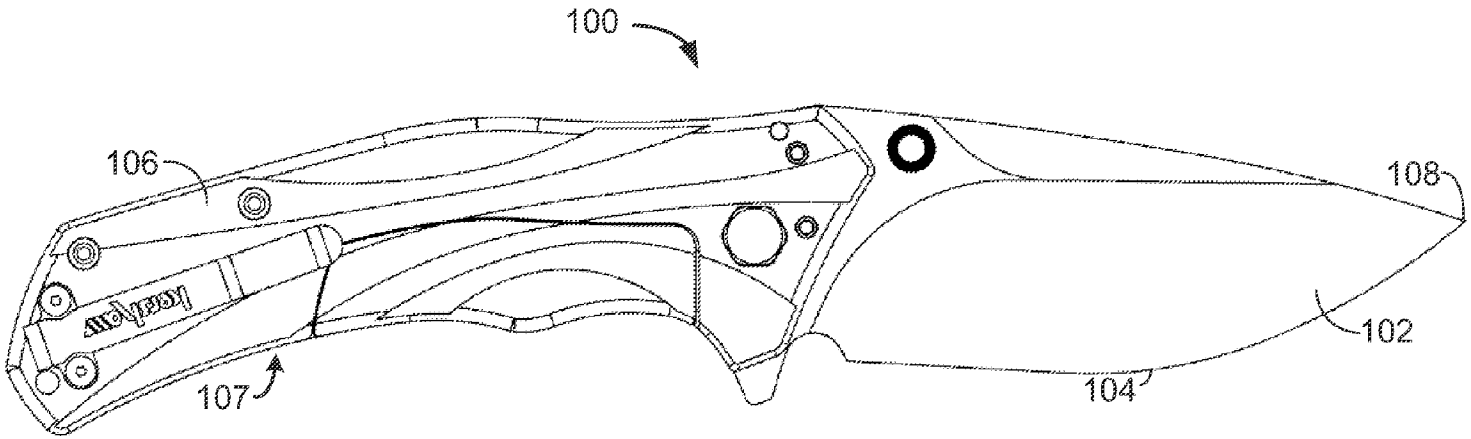
Figure 3A:
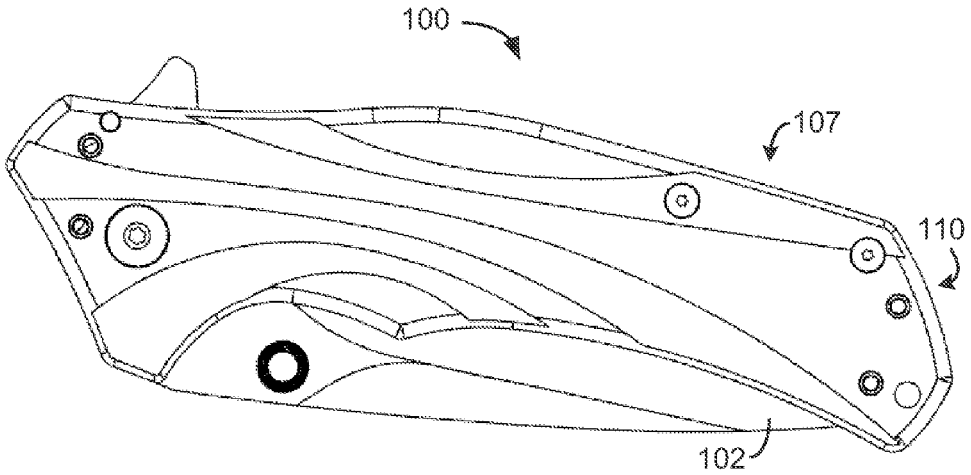
FIGS. 3A and 3B are plan views showing the knife of FIG. 1 in a closed position.
Figure 3B:
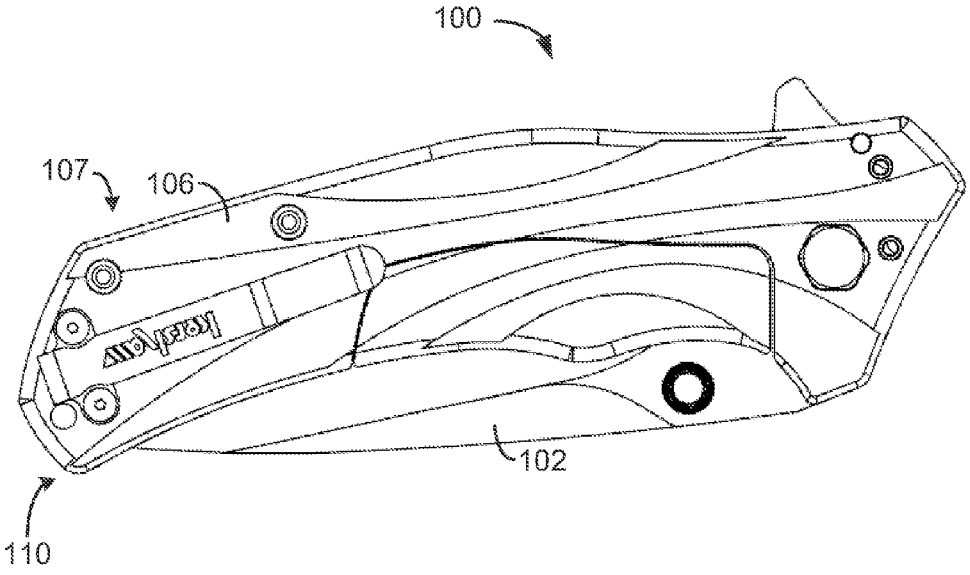

FIGS. 2A and 2B show knife 100 in an opened position. When opened, cutting edge 104 of blade 102 is exposed with a tip 108 of the blade extending away from a handle 107. FIGS. 3A and 3B show knife 100 in a closed position. When closed, the cutting edge of blade 102 is protected by handle 107, and the tip of blade 102 is proximate a non-pivoting end 110 of handle 107.

Figure 4A:
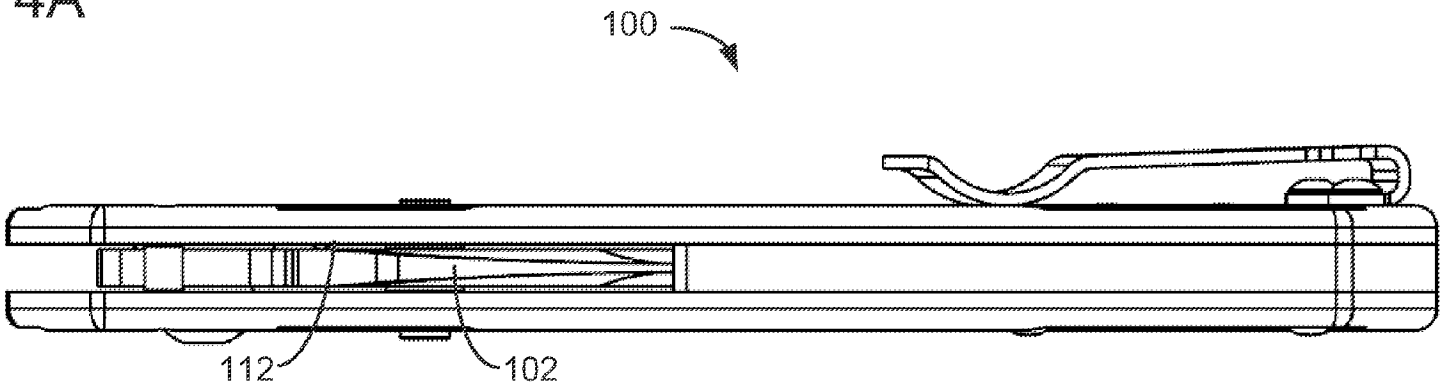
FIGS. 4A and 4B are elevation views showing the knife of FIG. 1 in a closed position.
Figure 4B:
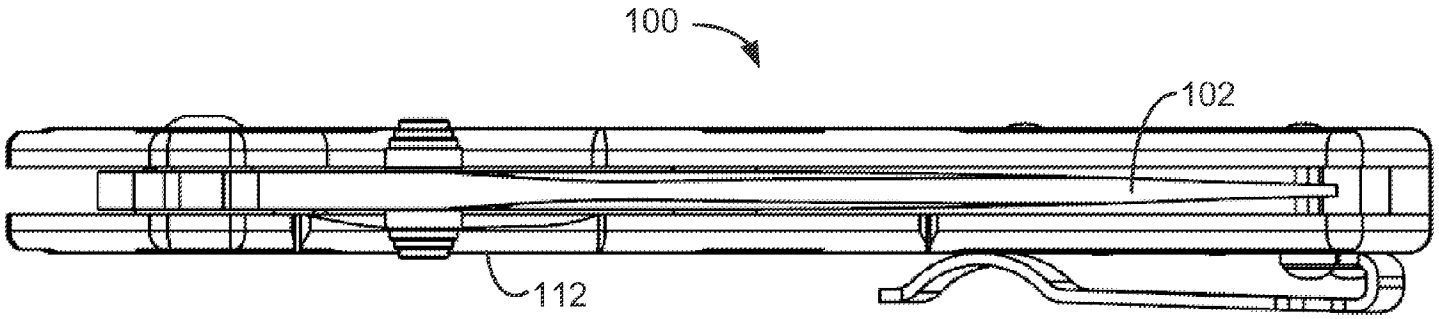

Returning to FIG. 1, knife 100 includes a lockbar 112 that is configured to automatically lock the knife in the opened position when the blade is pivoted to the opened position. As shown in FIGS. 4A and 4B, lockbar 112 is out of the folding plane of blade 102 when the knife is in the closed position. However, the lockbar is biased towards the blade. As such, only the presence of the blade in the closed position keeps the lockbar from moving into the folding plane of the blade. When blade 102 is pivoted to the opened position and out of the way of the lockbar, the biasing of the lockbar causes the lockbar to move into the folding plane of the blade.

Figure 5A:
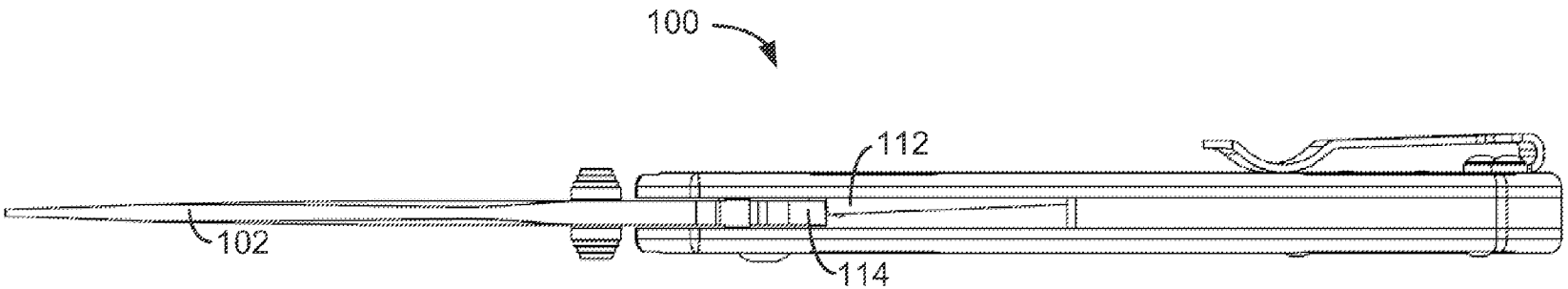
FIGS. 5A and 5B are elevation views showing the knife of FIG. 1 in an opened position.
Figure 5B:
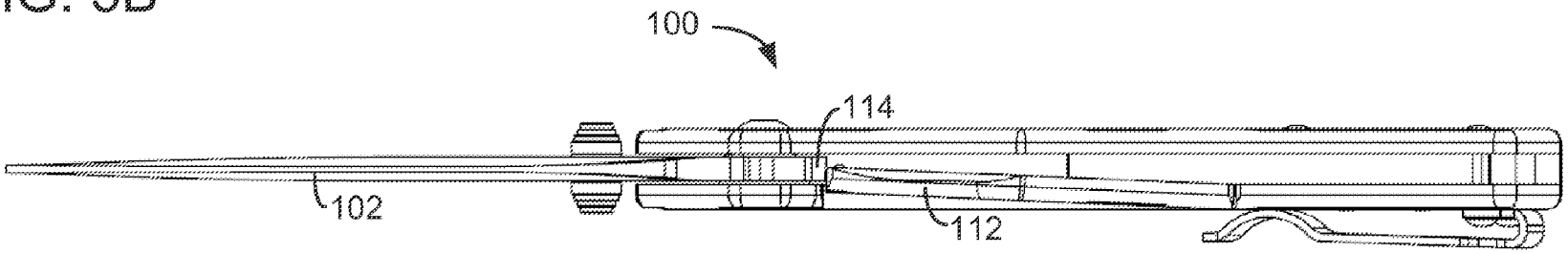

FIGS. 5A and 5B show the lockbar 112 engaging a tang 114 of blade 102. With the lockbar in the folding plane of the blade and engaging the tang of the blade, the blade is unable to pivot to the closed position—i.e., the knife blade is locked in the opened position. As such, in order to close the knife, the lockbar may be manually moved out of the folding plane so as not to engage the tang of the blade. While the lockbar is held against its bias so as not to engage the tang, the blade may be manually pivoted back to the closed position. After being returned to the closed position, the blade prevents the lockbar from moving back into the folding plane of the blade.

Knives, including but not limited to knife 100, in accordance with the present disclosure include a lockbar that is a separate piece than the handle. Because the lockbar and the handle are separate pieces, the lockbar may be made from a different material than the handle. In particular, it may be desirable to construct the handle from a material that is relatively lighter than the material(s) that is/are used to construct the lockbar. In this way, the overall weight of the knife can be decreased, while the overall strength and wear characteristics of the lockbar remain adequate for locking the blade in the opened position. Nonlimiting examples of suitable materials for the handle include, but are not limited to, carbon fiber, plastic, titanium, and aluminum. Nonlimiting examples of suitable materials for the lockbar include, but are not limited to, steel, aluminum, and titanium.

As a nonlimiting example, FIG. 1 shows lockbar 112 detachably connectable to back handle 106. The lockbar may be connected to the back handle 106, and/or another portion of the handle, in any suitable manner. In the illustrated example, FIG. 1 shows two lockbar attachment screws 146 that fasten the lockbar 112 to the back handle 106. However, other fastening mechanisms may be used without departing from the scope of this disclosure. As nonlimiting examples, rivets or adhesives may be used.

The portion of the handle to which the lockbar is connected may be shaped so as to at least partially mate with the lockbar. As a nonlimiting example, FIG. 1 shows a pocket 116 formed in back handle 106. Pocket 116 is shaped with the same profile as a tail portion 118 of lockbar 112. Further, pocket 116 is shaped with approximately the same depth as the thickness of tail portion 118.

Figure 6A:
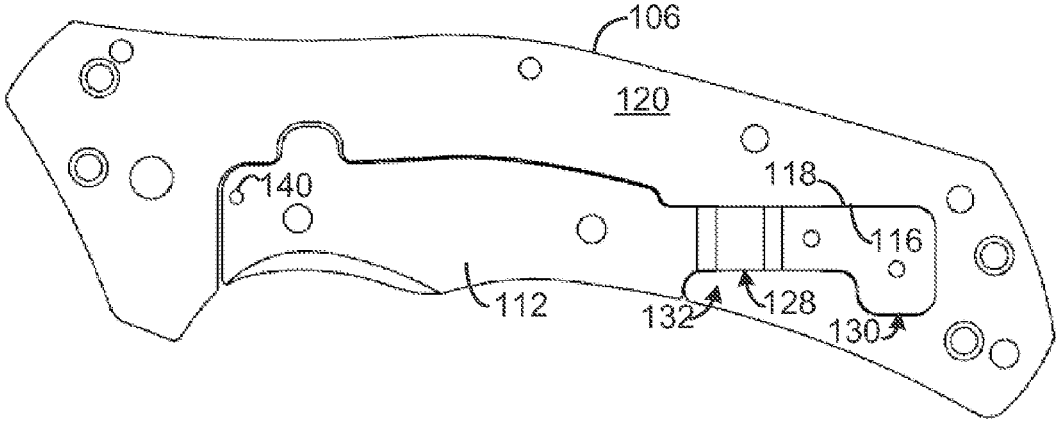
FIGS. 6A and 6B are plan views showing the back handle and lockbar of the knife of FIG. 1.
Figure 6B:
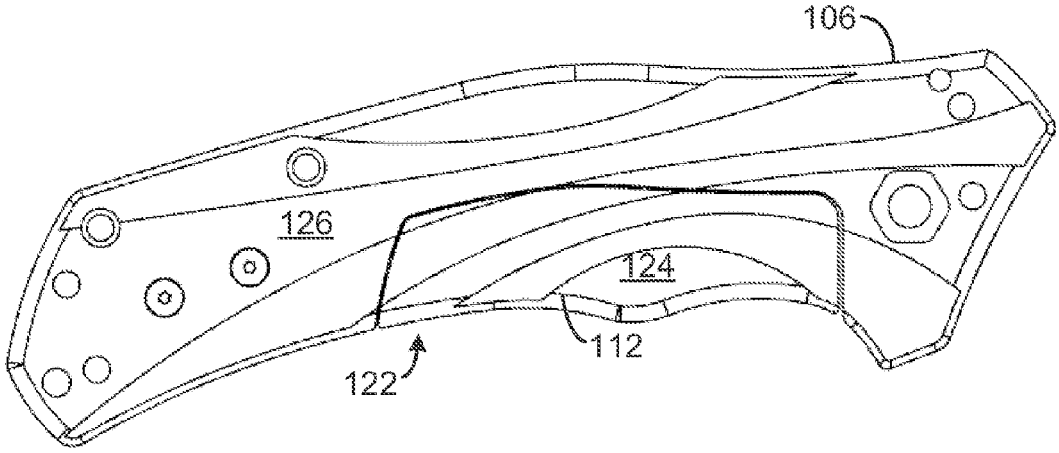

As illustrated in FIG. 6A, when tail portion 118 is fit into pocket 116, there is little to no gap between the sidewalls of the tail portion and the sidewalls of the pocket. In this way, the pocket mechanically secures the lockbar in place. Furthermore, when the tail portion of the lockbar is fit into the pocket, the tail portion is substantially flush with the inside surface 120 of back handle 106. Moreover, as shown in FIG. 6B, the thickness of a head portion 122 of lockbar 112 may be substantially the same as a thickness of back handle 106. In this way, the visible portion 124 of the lock bar is substantially flush with the outside surface 126 of the back handle when the blade is in the closed position. In other embodiments, the pocket may be sized to accommodate the entire lockbar so that the handle effectively hides the lockbar from view.

Pocket 116 and tail portion 118 are provided as nonlimiting examples. Other knives within the scope of this disclosure may include differently shaped pockets and tail portions. In some embodiments, the tail portion of a lockbar may include a relatively narrow neck portion and a relatively wide end portion. FIG. 6A shows an example narrow neck portion 128 and wide end portion 130. In some embodiments, the pocket may be defined by a handle portion that spaces the pocket from an edge of the handle, thus creating a wrap-around pocket. FIG. 6A shows an example handle portion 132 that creates such a wrap-around pocket 116.

Single-piece and multi-piece lockbars may be used without departing from the scope of this disclosure. FIG. 1 shows a nonlimiting example of a single-piece lockbar 112.

Figure 7:
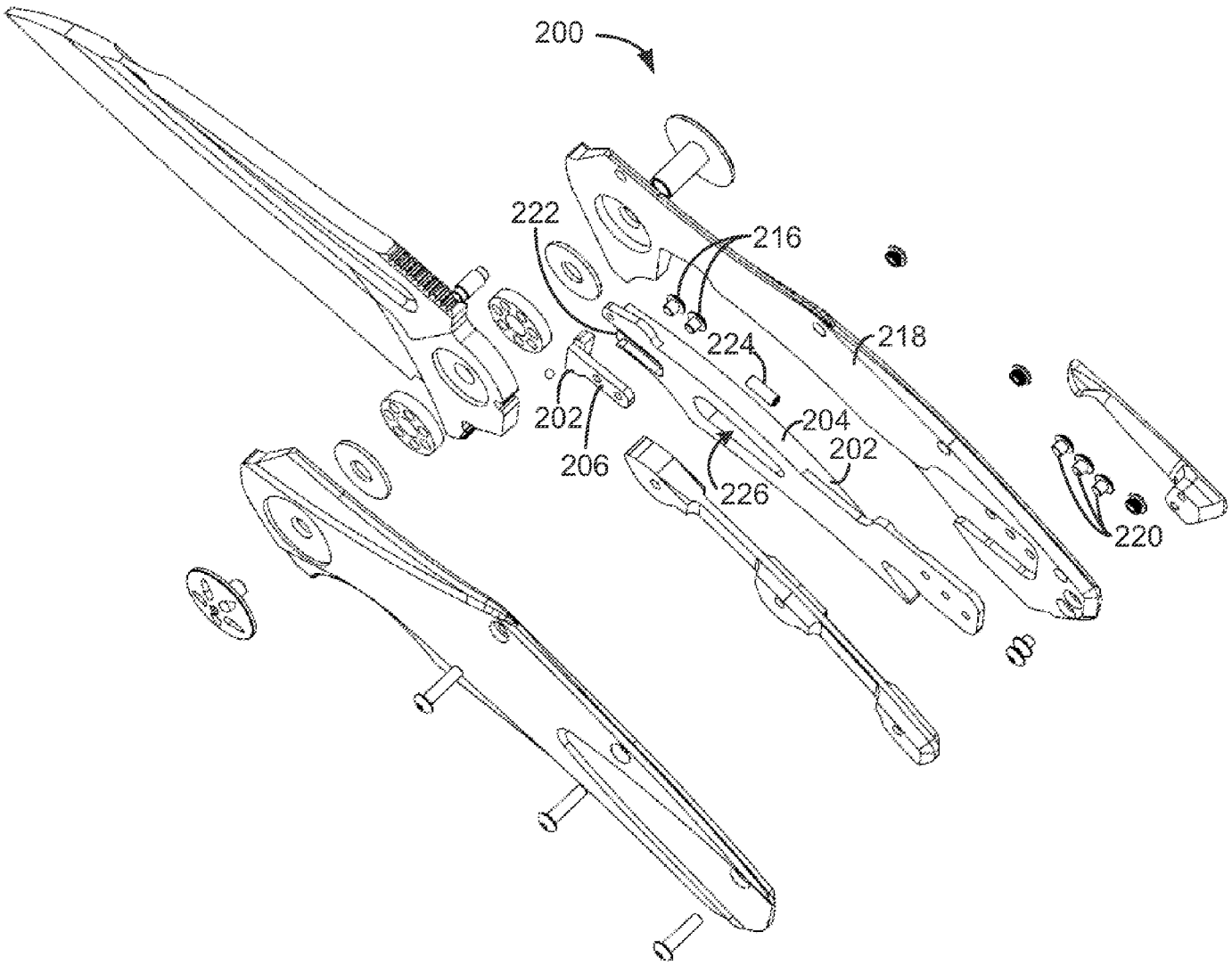
FIG. 7 is an exploded view of another example folding knife in accordance with another embodiment of the present disclosure.

FIG. 7 shows an exploded view of a folding knife 200 in accordance with another example embodiment of the present disclosure. Knife 200 is a nonlimiting example of a knife including a multi-piece lockbar 202. In particular, multi-piece lockbar 202 includes an arm 204 and a puck 206. Like the single-piece lockbar described above, the arm includes a tail portion and a head portion, and the tail portion includes a relatively narrow neck portion and a relatively wide end portion. However, unlike the single-piece lockbar described above, arm portion 204 of multi-piece lockbar 202 does not directly engage the tang of the knife blade. Instead, puck 206 engages the tang.

Multi-piece lockbars that include a separate puck for engaging the tang of the blade may be variably connected to the arm so that the position of the puck relative to the tang can be adjusted. In the embodiment illustrated in FIG. 7, puck 206 is connected to arm 204 by two lockbar puck attachment screws 216. Arm 204 is detachably connected to back handle 218 by three lockbar attachment screws 220.

Arm 204 has a pocket 222 into which puck 206 fits. The position of puck 206 within pocket 222 may be tuned, and the lockbar puck attachment screws 216 may be used to secure the puck in the tuned position. In the illustrated embodiment, a set screw 224 that is accessible via an opening 226 in arm 204 may be adjusted to tune the position of puck 206.

In other embodiments, the puck may be configured to move in a substantially linear direction via one or more screws configured to slide in one or more grooves. The motion of the puck in said embodiments may be limited via one or more set screws.

After the puck and/or blade tang wear from use, the position of the puck relative to the arm may be adjusted so that the puck properly engages the tang to provide a secure lock when the blade is opened. In other embodiments, a position of a single-piece or multi-piece lockbar relative to a handle may be tuned in order to move a tang engagement surface of the lockbar into the proper position for locking the blade in an opened position. In other words, the entire lockbar may be adjusted relative to the handle as opposed to a puck of a multi-piece lockbar being adjusted relative to the arm of a multi-piece lockbar. In such embodiments, the pocket may be sized and shaped to accommodate changing the position of the lockbar relative to the handle.

For example, the lockbar may be configured to be adjustable via one or more set screws. In addition, the motion of the lockbar may be limited via adjustment of a threaded shaft. In another embodiment, a folding knife may include an adjustable pocket. The position of the pocket may be adjusted in one or more directions via one or more set screws.

In some embodiments, the arm of a multi-piece lockbar may be constructed from a material that is relatively lighter than the material used to construct the puck of the multi-piece lockbar. Because only the puck engages the tang, the material from which the arm is constructed need not possess the same wear characteristics as the puck. By constructing the arm from a lighter material than the puck, the overall weight of the knife may be further reduced.

Both single-piece and multi-piece lockbars may optionally include a stop that prevents the lockbar from being manually moved past flush with an outside surface of the handle. For example, returning to FIG. 1, lockbar 112 includes a stop 134 that is aligned with a pocket 136 in back handle 106. The position and thickness of stop 134 and the position and depth of pocket 136 are cooperatively configured so that the inside surface 138 of the lockbar can be pressed flush with the inside surface 139 of the back handle 106. However, the stop prevents the outside surface of the lockbar from being pressed past flush with the outside surface of the back handle.

In some embodiments, the lockbar and the blade may include corresponding components of a catch assembly that provides an initial resistance to knife opening. For example, the lockbar may include a semispherical protrusion that engages a corresponding detent on the blade when the blade is in a closed position. As another example, the lockbar may include a detent and the blade may include a semispherical protrusion. Such a detent or protrusion may be located on a single-piece lockbar or on the arm or puck of a multi-piece lockbar. FIG. 6A shows a nonlimiting example of such a protrusion 140 on lockbar 112. It is to be understood that other catch assemblies may be used without departing from the scope of this disclosure.

In some embodiments, a knife in accordance with the present disclosure may include an assisted opening mechanism. As a nonlimiting example, FIG. 1 shows a torsion spring 142 that biases the blade towards the closed position when the knife is closed or nearly closed. However, when the knife is opened past a threshold angle, the torsion spring biases the blade towards the opened position. As such, torsion spring 142 will automatically complete opening of the blade after a user manually initiates the opening.

In some embodiments, screws or other fasteners that are used to detachably connect the lockbar to the handle may be hidden by clips or other aspects of the knife. For example, FIG. 1 shows a clip 144 that hides lockbar attachment screws 146 from view.

The invention claimed is:

1. A folding knife, comprising:

a blade including a tang;

a handle pivotably connected to the blade, the handle including a visible side facing away from the blade and an interior side facing toward the blade, the interior side defining a pocket; and a lockbar separate from the handle and connected to the handle, the lockbar including a tail portion having a tail profile that matches a pocket profile of the pocket, the tail portion mated to and filling the pocket such that an inside edge of the pocket encloses an outside edge of the tail portion of the lockbar, a head portion of the lockbar distal from the tail portion of the lockbar biased toward a folding plane of the blade and configured to engage the tang to lock the blade in an open position relative to the handle, the head portion of the lockbar extending from the pocket into a void defined by the handle and including a visible side facing away from the blade and an interior side facing toward the blade, the visible side of the head portion of the lockbar within the void defined by the handle being substantially flush with the visible side of the handle when the blade is in a closed position, and the visible side of the handle being generally parallel to the folding plane of the blade.

2. The folding knife of claim 1, wherein the handle includes a first handle piece opposing a second handle piece between which the blade is pivotably connected, the first handle piece including the pocket.

3. The folding knife of claim 2, wherein a thickness of the first handle piece at the pocket is less than a thickness of the first handle piece around the pocket.

4. The folding knife of claim 2, wherein the first handle piece defines the void adjacent to the pocket, and wherein the lockbar extends from the pocket into the void.

5. The folding knife of claim 4, wherein a shape of a handle portion of the lockbar extending into the void substantially matches a shape of the void.

6. The folding knife of claim 2, wherein a thickness of a handle portion of the lockbar extending from the pocket is substantially the same as a thickness of the first handle piece around the pocket.

7. The folding knife of claim 6, wherein an inner surface of the handle portion of the lockbar is substantially flush with a portion of the first handle piece around the pocket when the tail portion is fit in the pocket.

8. The folding knife of claim 1, wherein the lockbar includes a stop spaced away from the tail portion of the lockbar and configured to prevent the lockbar from being manually moved past flush with an outside surface of the handle.

9. The folding knife of claim 1, wherein a thickness of the tail portion of the lockbar fit in the pocket is substantially the same as a depth of the pocket.

10. The folding knife of claim 1, wherein an inner surface of the tail portion of the lockbar is substantially flush with a portion of the first handle piece around the pocket when the tail portion is fit in the pocket.

11. The folding knife of claim 1, wherein the pocket has a hooked profile that includes a neck portion that is relatively narrower than an end portion.

12. The folding knife of claim 1, wherein the lockbar is made of a lighter material than the handle.

13. The folding knife of claim 1, wherein the lockbar is a multi-piece lockbar including an arm having a tail portion and a head portion and a puck that engages the tang of the blade, a position of the puck adjustable relative to the arm.

14. The folding knife of claim 13, wherein the arm has a pocket into which the puck adjustably fits.

15. The folding knife of claim 13, wherein the position of the arm relative to the puck is adjustable such that the puck properly engages the tang to provide a secure lock when the blade is in the open position.

16. The folding knife of claim 13, wherein the position of the puck relative to the tang is adjustable.

17. The folding knife of claim 13, wherein the arm is made of a lighter material than the puck.

18. The folding knife of claim 1, wherein the lockbar and the blade include a catch assembly providing initial resistance to knife opening, the catch assembly including a spring that biases the blade toward a closed position when the knife is closed past a threshold angle, and that biases the blade toward the open position when the knife is open past the threshold angle.

19. A folding knife, comprising:

a blade including a tang;

a first handle piece including a tail pocket and a stop recess;

a second handle piece that opposes the first handle piece such that the blade is pivotably connected between the first handle piece and the second handle piece;

a lockbar separate from the first handle piece and the second handle piece and connected to the first handle piece by a tail portion of the lockbar fit in the pocket, wherein a shape of the tail portion of the lockbar fit in the pocket matches a shape of the pocket, the lockbar including a head portion extending from the pocket into a void defined by the first handle piece, the head portion including an outer face that is substantially parallel with a folding plane of the blade and substantially flush with an outer face of the first handle piece, the lockbar biased toward a folding plane of the blade and configured to engage the tang to lock the blade in an open position relative to the first handle piece and the second handle piece, the lockbar including a stop spaced away from the tail portion and configured to fit into the stop recess of the first handle piece to prevent the outer face of the head portion of the lockbar from moving past flush with the outer face of the first handle piece.

20. A folding knife, comprising:

a blade including a tang;

a first handle piece having a first thickness and including a pocket having a depth that is less than the first thickness;

a second handle piece opposing the first handle piece such that the blade is pivotably connected between the first handle piece and the second handle piece; and a lockbar including a tail portion having a second thickness that is substantially the same as the depth of the pocket, and a handle portion having a third thickness that is substantially the same as the first thickness, the handle portion of the lockbar extending from the pocket into a void defined by the first handle piece, an outer surface of the handle portion and the first handle piece cooperating to form a grippable region that is generally parallel to a folding plane of the blade, the lockbar separate from the first handle piece and connected to the first handle piece via the tail portion fit in the pocket, the lockbar biased toward a folding plane of the blade and configured to engage the tang to lock the blade in an open position relative to the first handle piece and the second handle piece.

* * * * *